US005092079A

United States Patent [19]

Brookman et al.

[11] Patent Number: 5,092,079

[45] Date of Patent: Mar. 3, 1992

[54] WEATHER SEAL FOR A GARAGE DOOR

[75] Inventors: Marc A. Brookman, Dearborn; Norman C. Jackson, Livonia, both of Mich.

[73] Assignee: The Standard Products Company, Cleveland, Ohio

[21] Appl. No.: 253,963

[22] Filed: Oct. 5, 1988

[51] Int. Cl.[5] ..... E06B 7/16

[52] U.S. Cl. ..... 49/496; 160/40

[58] Field of Search ..... 160/40, 41, 133, 266, 160/268.1, 269, 270, 271, 272, 273.1; 16/87 R, 87 B, 94 R, 95 R, 96 R; 49/475, 493, 496, 500, 406

[56] References Cited

U.S. PATENT DOCUMENTS

| | | | |
|---|---|---|---|
| 1,566,651 | 12/1925 | Christensen | 49/475 |
| 2,655,698 | 10/1953 | Chalik et al. | 49/500 X |
| 3,023,804 | 7/1959 | Howell, Sr. . | |
| 3,079,653 | 3/1963 | Cornell | 49/493 |
| 3,131,441 | 5/1964 | Cornell | 49/493 X |
| 3,581,884 | 6/1967 | Caldwell et al. . | |
| 4,441,301 | 8/1982 | Benson . | |
| 4,525,953 | 10/1983 | Stutzman . | |
| 4,586,552 | 5/1986 | Labelle | 160/133 |
| 4,635,400 | 7/1987 | Mullet . | |
| 4,771,816 | 9/1988 | Clay | 160/40 X |

OTHER PUBLICATIONS

American Door Company, "Save-Stop and Saver-S-trip", 1985, brochure.

Plycraft Plastics Division, "Custom Garage Door Seals", Aug. 1985, brochure.

"Foam Stop", Jan. 1986, brochure.

Plycraft Plastics Division, "Strip-Stop", brochure.

*Primary Examiner*—David M. Purol

*Attorney, Agent, or Firm*—Harness, Dickey & Pierce

[57] ABSTRACT

The present invention is a weather seal for a garage door having a base member secured to a support surface. A block is pivotally connected to the base member for pivotal movement relative to the base member. A sealing lip is connected to the block and has a first position in the plane of the base member. The block includes a first triangular for engaging the support surface for pivotally moving the block and sealing lip at an angle to the base member when installed so that the sealing lip engages a door to effect a seal between the door and the sealing lip.

10 Claims, 1 Drawing Sheet

WEATHER SEAL FOR A GARAGE DOOR

BACKGROUND OF THE INVENTION

1. Field of the Invention

The present invention relates to weather seals, and more particularly, to a weather seal for a roll up type garage door.

2. Description of Related Art

Currently, conventional garage door seals being made are combination door stops and seals. Most of these seals have a rigid base with a flexible sealing lip. The sealing lip generally protrudes from the base at an angle. One problem with the rigid base seal is that it must be sold in cut lengths. This makes the rigid base seal costly. Also, the rigid base seal cannot be rolled up into a coil, which makes it cumbersome to package and transport.

Another type of garage door seal is a coilable seal. The problem with the coilable seal is that the sealing lip must be in the same plane as the base for proper coiling. This decreases the effectiveness of the sealing aspect because the sealing lip must be at an angle when installed to be effective.

It is, therefore, an object of the present invention to provide a sealing lip that can be coiled and yet, when installed, be at an angle to effect proper sealing.

SUMMARY OF THE INVENTION

Accordingly, the present invention is a weather seal for a roll-up type garage door having a gap between the door and a support surface. The weather seal includes a base member secured to the support surface. A block is pivotally connected to the base member for pivotal movement relative to the base member. A sealing lip is connected to the block and has a first position in the plane of the base member. The block has a means for engaging the support surface for pivotally moving the block and moving the sealing lip to a second position at an angle to the base member when installed so that the sealing lip engages the door to effect a seal between the door and the sealing lip.

One advantage of the present invention is that the base member can be coiled. Another advantage of the present invention is that the sealing lip can be made in the plane of the base member and forced into an angled position when installed. Further, the present invention maintains the sealing lip in the angled position, eliminating cyclical stresses on the pivot point.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
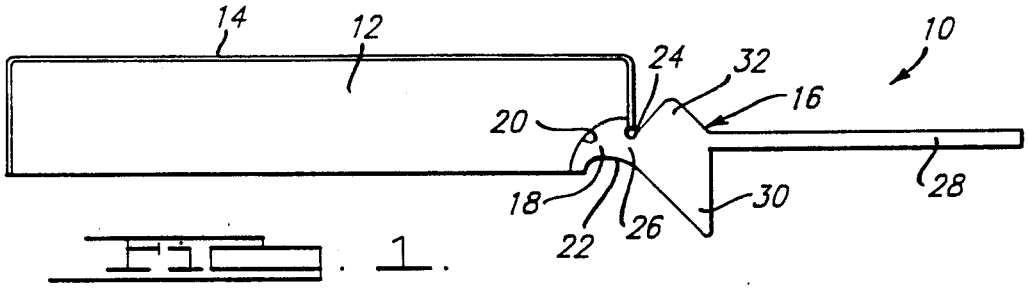
FIG. 1 is a side elevational view of the weather seal according to the present invention.

Referring to FIG. 1, a weather seal 10 for a conventional roll-up type garage door having a gap between the door and a support surface is shown. The weather seal 10 includes a base member 12 having a generally rectangular shape. The base member 12 is made of an elastomeric polymer material such as a flexible polyvinyl chloride (PVC) or a thermoplastic elastomer (TPE) to allow the base member 12 to be coiled. The PVC may have a hardness of 75–85 (Shore A). It should be appreciated that the base member 12 could be made from two different hardness materials such that a dual-durometer base member 12 is provided.

The weather seal 10 may, optionally, include an outer skin 14 disposed about the exposed surface of the base member 12. The outer skin 14 may be a textured surface, a pigmented surface, or a paintable surface. It should be appreciated that the base member could be embossed with a texture such as a wood surface.

The weather seal 10 further includes a block 16 pivotally connected to the base member 12. The block 16 has an outwardly extending attachment portion 18 to allow the block 16 to be attached to the base member 12. The attachment portion 18 is arcuate. The block 16 and attachment portion 18 are coextruded with the base member 12 to secure or attach the block 16 to the base member 12. The attachment portion 18 is disposed in a complementary arcuate cavity 20 formed along one edge of the base member 12. Recessed portions 22 and 24 are formed on opposite sides between the attachment portion 18 and the block 16 to form a pivotal portion 26. The pivotal portion is smaller in thickness and is more flexible than the attachment portion 18 and the block 16 to allow pivotal flexible of the block 16 relative to the base member 12.

Figure 3:
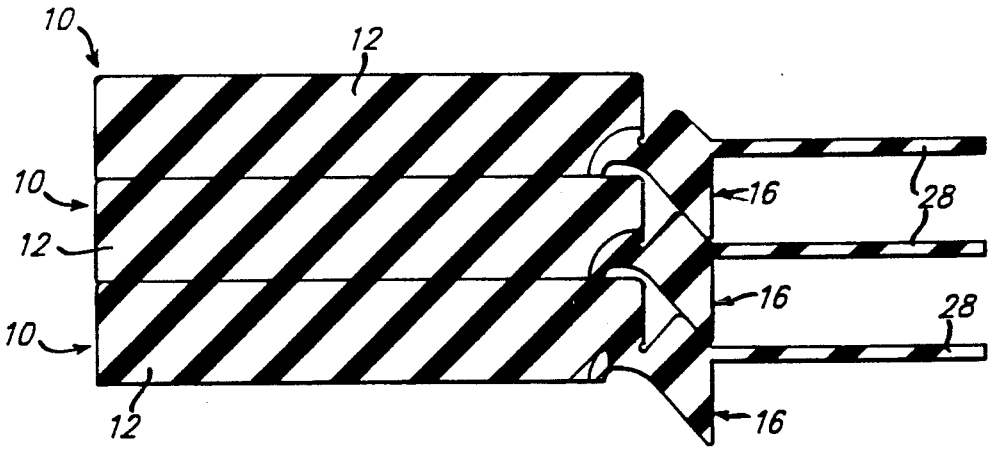
FIG. 3 is a sectional view of the weather seal of FIG. 1 in a coiled position.

The weather strip 10 further includes a sealing lip 28 connected at one end to the block 16. The sealing lip 28 has a first position in the plane of the base member 12. In other words, the sealing lip 28 is extruded in the plane of the base member 12. This allows the weather seal 10 to be rolled up in a coil, i.e. coiled as illustrated in FIG. 3. The sealing lip 28 is made of a polymer material having a hardness similar to the base member 12. It should be appreciated that a softer material could be used for the sealing lip 28 if more flexibility is needed.

Figure 2:
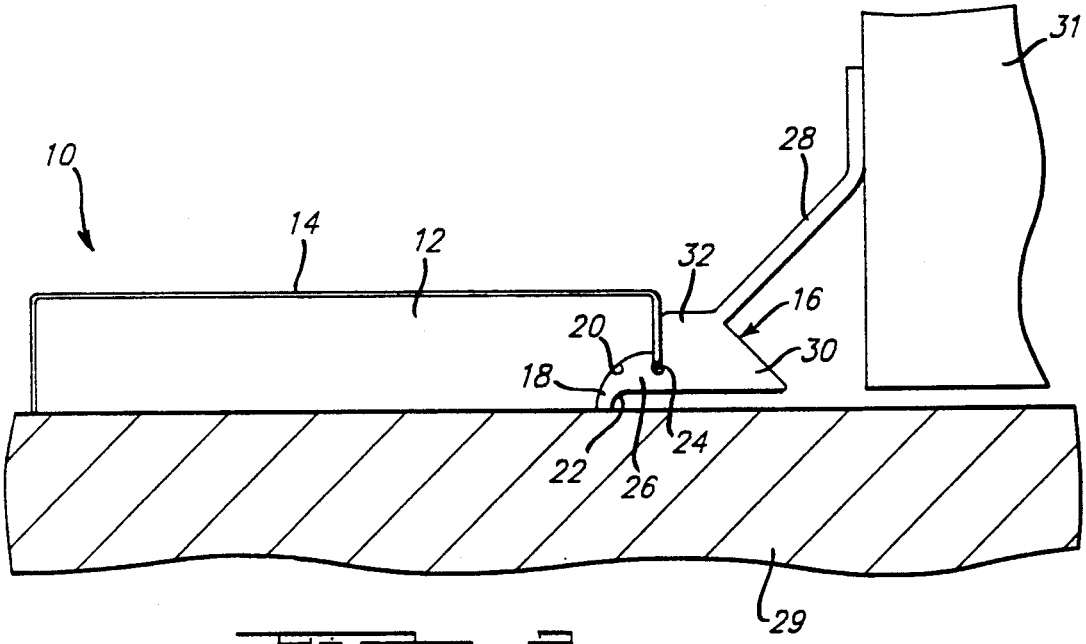
FIG. 2 is a side elevational view of the weather seal of FIG. 1 in the installed position.

Referring to FIG. 2, the base member 12 of the weather seal 10 is attached by suitable means to a support surface 29 such as a door jam. The block 16 includes a first or lower portion 30 having a generally triangular shape and extending outwardly for engaging the support surface 29 for pivotally moving the block 16 and sealing lip 28. The sealing lip 28 is pivotally moved or rotated to a second position which is at an angle to the plane of the base member 12 to engage a door 31 such as a roll up type garage door to effect a seal between the door 31 and the sealing lip 28. In other words, when installed, the first portion 30 will force the sealing lip 28 into an angled position to engage the door 31 for effective sealing.

The block 16 also includes a second or upper portion 32 having a generally triangular shape to limit the pivotal movement of the block 16 in the installed position. In other words, the second portion 32 is a stop to keep the sealing lip 28 from pivoting more than the desired or predetermined angle relative to the base member 12.

According, the first 30 and second 32 portions are located such that the weather seal 10 can be coiled without these portions interfering. The first 30 and second 32 portions are used to pin the sealing lip 28 into position, when installed, therefore, eliminating cyclical stresses on the pivot point.

The present invention has been described in an illustrative manner. It is to be understood that the terminology which has been used is intended to be in the nature of word of description rather than of limitation.

Obviously, many modifications and variations of the present invention are possible in light of the above teachings. Therefore, the present invention may be practiced otherwise than as specifically described.

What is claimed is:

1. A weather seal for a garage door having a gap between the door and a support surface comprising:

a base member adapted to be secured to a support surface, said base member extending longitudinally in a plane along the support surface;

a block pivotally connected to said base member for pivotal movement relative to said base member;

a sealing lip connected to said block and having a first position in the plane of said base member; and said block having a first triangular portion extending outwardly toward the support surface and adapted to engage the support surface for pivotally moving said block and said sealing lip to a second position at an angle to the plane of said base member when installed so that said sealing lip is adapted to engage a door to effect a seal between the door and said sealing lip.

2. A weather seal as set forth in claim 1 wherein said block includes a second triangular portion opposite said first triangular portion and extending outwardly away from the support surface to limit the pivotal movement of said block in the installed position.

3. A weather seal as set forth in claim 2 wherein said block includes an outwardly extending attachment portion.

4. A weather seal as set forth in claim 3, wherein said base member includes means forming a cavity portion, said attachment portion being disposed in said cavity portion.

5. A weather seal for a garage door having a gap between the door and a support surface comprising:

a base member adapted to be secured to a support surface, said base member extending longitudinally in a plane along the support surface;

a block pivotally connected to said base member for pivotal movement relative to said base member;

a sealing lip connected to said block and having a first position in the plane of said base member;

said block having a first triangular portion extending outwardly toward the support surface and adapted to engage the support surface for pivotally moving said block and said sealing lip to a second position at an angle to the plane of said base member when installed so that said sealing lip is adapted to engage a door to effect a seal between the door and said sealing lip;

said block including a second triangular portion opposite said first triangular portion and extending outwardly away from the support surface to limit the pivotal movement of said block in the installed position;

said block including an outwardly extending attachment portion;

said base member including means forming a cavity portion; said attachment portion being disposed in said cavity portion; and means forming a recess portion between said attachment portion and said first triangular portion to allow pivotal movement.

6. A weather seal as set forth in claim 5 wherein said sealing lip is made of a flexible material.

7. A weather seal as set forth in claim 6 including an outer skin disposed about one side of said base member.

8. A weather seal as set forth in claim 7 wherein said base member is made from at least two different hardness materials.

9. A weather seal for a garage door having a gap between the door and a support surface comprising:

a base member adapted to be secured to a support surface, said base member extending longitudinally in a plane along the support surface;

an outer skin disposed about at least one side of said base member opposite the support surface;

a block pivotally connected to said base member for pivotal movement relative to said base member;

a sealing lip integrally formed with said block and made of a flexible material, said sealing lip having a first position extending longitudinally in the plane of said base member and a second position at an angle to the plane of said base member when installed and adapted to engage a door to effect a seal between the door and said sealing lip;

said block having one triangular portion extending outwardly away from the support surface and adapted to engage said base member to limit the pivotal movement of said block in an installed position;

said block having another triangular portion extending outwardly opposite said one triangular portion toward the support surface and adapted to engage the support surface for pivotally moving said block and said sealing lip to the installed position;

said block having a longitudinally extending attachment portion opposite said sealing lip;

said base member having a cavity portion at one end adjacent the support surface, said attachment portion being disposed in said cavity portion; and a recess portion between said attachment portion and said one triangular portion.

10. A weather seal for a garage door having a gap between the door and a support surface comprising:

a base member adapted to be secured to a support surface, said base member extending longitudinally in a plane along the support surface;

a block pivotally connected to said base member for pivotal movement relative to said base member;

a sealing lip connected to said block and having a first position extending longitudinally substantially parallel to the plane of said base member;

said block having a first triangular portion extending outwardly toward the support surface and adapted to engage the support surface for pivotally moving said block and said sealing lip to a second position at an angle to the plane of said base member when installed so that said sealing lip is adapted to engage a door to effect a seal between the door and said sealing lip;

said block including a second triangular portion opposite said first triangular portion and extending outwardly away from the support surface and adapted to engage said base member to limit the pivotal movement of said block in an installed position; and said first and second triangular portions being located such that said weather seal can be coiled to allow said base member and said sealing lip to extend longitudinally in parallel planes.

* * * * *